United States Patent [19]

Feibelman

[11] 4,322,007

[45] Mar. 30, 1982

[54] DISPLAY STAND

[75] Inventor: Jeffrey A. Feibelman, Cranston, R.I.

[73] Assignee: A & H Mfg. Co., Cranston, R.I.

[21] Appl. No.: 133,279

[22] Filed: Mar. 24, 1980

[51] Int. Cl.[3] ..... A47F 7/02

[52] U.S. Cl. ..... 211/163; 211/13; 211/182

[58] Field of Search ..... 211/163, 182, 191, 13, 211/190, 208; 206/468, 486; 403/217, 231, 217, 396, 219; 108/111

[56] References Cited

U.S. PATENT DOCUMENTS

| | | | |
|---|---|---|---|
| 3,259,079 | 7/1966 | Freeman | 108/111 X |
| 3,693,807 | 9/1972 | Larson | 211/163 |
| 4,093,077 | 6/1978 | Strasser | 211/194 |
| 4,155,457 | 5/1979 | Urlbert | 211/13 X |

FOREIGN PATENT DOCUMENTS

| | | | |
|---|---|---|---|
| 6603194 | 10/1966 | Netherlands | 403/231 |

*Primary Examiner*—Roy D. Frazier
*Assistant Examiner*—Robert W. Gibson, Jr.
*Attorney, Agent, or Firm*—Salter & Michaelson

[57] ABSTRACT

A display stand of the type having vertically spaced bars adapted to releasably receive display cards in suspended relation thereon. The display stand comprises vertically extending corner stanchions comprising wall portions extending in the plane of adjacent sides of the display stand, the inner surfaces of said wall portions removably receiving an elongated strip which extends for substantially the extent of said stanchion and which extends across each corner stanchions to define a generally triangular configuration in cross-section, said strips being provided with vertically spaced support means for receiving and supporting the ends of horizontal bars on which the display cards are mounted.

12 Claims, 10 Drawing Figures

DISPLAY STAND

BACKGROUND AND SUMMARY OF THE INVENTION

The present invention relates generally to display stands of the type normally used to display jewelry articles, although applicable to other types of small articles adapted to be mounted on display cards. Reference is particularly made to the type of display card that includes an integral hook-like portion adjacent its upper extremity whereby the hook-like portion may frictionally engage a horizontally extending bar or rod so that the display card is suspended therefrom, so that the article mounted on the display card may be conveniently viewed by a prospective purchaser, and the display card easily removed from its supporting bar or rod where closer inspection of the article is desired by the prospective customer. Display cards of this general type are disclosed and illustrated in Feibelman, U.S. Pat. No. 3,568,858 dated Mar. 9, 1971, (specifically the embodiment shown in FIG. 5) and in Feibelman, U.S. Pat. No. 4,175,660 dated Nov. 27, 1979.

The instant invention is concerned with the provision of a novel and improved display stand for receiving display cards of the type above-mentioned. In this connection, it has been found desirable to provide a display stand which may be constructed entirely of plastic parts, with the exception of fastening hardware, and which requires no expensive molds or dies, since the only molded parts used in the display stand may be extruded. In addition, it is desirable to provide a display stand of this type wherein a maximum number of display cards may be exhibited while utilizing a minimum amount of shelf space. Also, it is desirable to provide a display stand of the general character described wherein the component parts of the stand may be easily and inexpensively assembled.

To acheive these and other objectives of this invention, a display stand is provided comprising a plurality of corner stanchions which may be easily and inexpensively manufactured by using conventional plastic extrusion techniques, the corner stanchions each having a pair of wall portions which are connected to each other at the corner of the stanchion, said wall portions on their inner surface having means for releasably receiving an elongated strip which bridges or spans the interior of each corner stanchion so as to define a generally triangular configuration when viewed in cross-section. The strips, which extend for substantially the length of each corner stanchion, are each provided with vertically spaced support means adapted to receive and support the ends of the plurality of vertically spaced bars that extend from one corner stanchion to the next adjacent one. The aforesaid display cards are then hangingly mounted on the bars whereby each side of the display stand will have a plurality of rows of display cards mounted thereon. The bottom ends of the stanchions are secured to a base plate which in turn has secured to its bottom surface a turntable device, whereupon the display stand may be rotated so as to present any side thereof to a prospective purchaser. A top plate is secured to the uppermost ends of the stanchions, the top plate having suitable means thereon for receiving a name plate or a card identifying the jewelry being displayed.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 1:
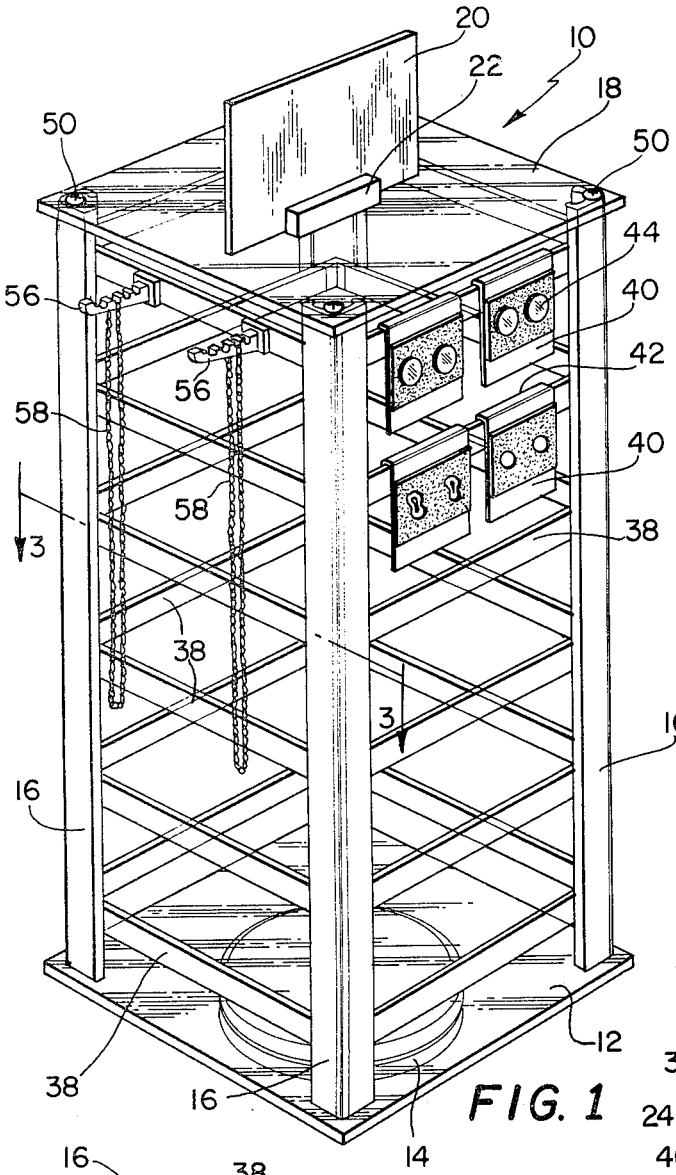
FIG. 1 is a perspective view of a display stand showing the instant invention.
Figure 2:
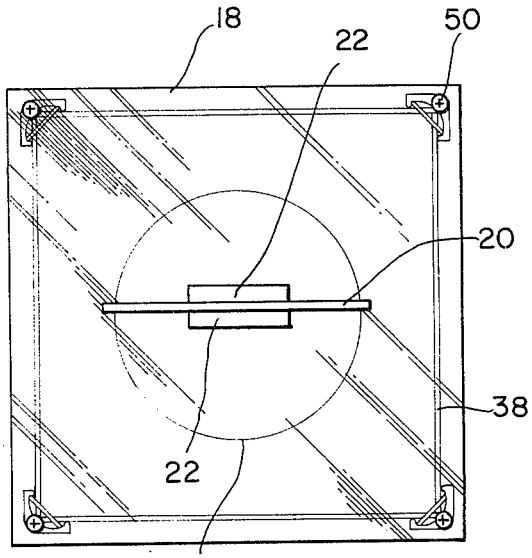
FIG. 2 is a top plan view thereof.

Referring now to the drawings, and more particularly to FIG. 1, the display stand of the present invention is shown generally at 10 and comprises a bottom or base wall 12 having a conventional turntable assembly 14 secured to the under surface thereof whereby the display stand 10 may be rotated to any desired position. Secured to the base 12 are a plurality of upright stanchions 16 which define the corners of the display stand. In the embodiment illustrated, there are four such stanchions 16 positioned so as to define a square configuration, it being noted that the base 12 is substantially square and supports the stanchion 16 adjacent its four corners. It will be understood, however, that any number of stanchions 16 may be provided to define any desired geometrical configuration in which case the base 12 would preferably conform to such geometrical configuration.

At the upper extremity of the stanchions 16, there is mounted a top wall 18 having thereon any support means for receiving and supporting a name plate 20. Specifically, said support means comprises a pair of spaced blocks 22 which frictionally and releasably receive therebetween the name plate 20.

The stanchions 16 preferably comprise an elongated extrusion of a lightweight but durable plastic material and each stanchion consists of first and second wall portions 24, 26 each of which extends generally along the plane of the adjacent side of the display. Thus, where the display is of a generally square configuration, as illustrated in the drawings herein, the wall portions 24, 26 are generally perpendicular to each other so as to define an elongated right angle channel. Adjacent their free extremities, the wall portions 24, 26 are each provided with an inwardly extending rib 28, 30 which define vertically extending grooves 32 which in turn create a vertical trackway for slidably receiving corner strips 34, as shown most clearly in FIGS. 4 through 6. The strips 34 extend for substantially the entire vertical extent of each stanchion 16, it being understood that the strips are slidably inserted downwardly into the top end of each stanchion as illustrated in FIG. 6, before top wall 18 has been mounted in position. As will be noted, after the strips 34 have been slidably inserted into their respective stanchions, each strip and stanchion defines a generally triangular configuration when viewed in cross-section.

The strips 34 are each provided with a series of vertically spaced notches or cutouts 36 along its opposite longitudinal edges, with opposed notches in each strip being in alignment as illustrated in FIG. 6. In addition, the notches 36 in each strip 34 are in horizontal alignment with the notches 36 of the other corner strips whereby the notches 36 along one edge of a corner strip 34 are adapted to cooperate with the notches 36 of the next adjacent corner strip to receive horizontally extending bars 38. Specifically, the bars 38 are preferably of a rectangular cross-section and are of a plastic construction wherein the bars 38 may be flexed across their smaller dimension, as illustrated in FIG. 5. This is important because in order to mount each bar 38 in the aligned notches 36 of adjacent corner strips 34, it is necessary to flex the bar 38, as illustrated in FIG. 5, so as to effectively shorten the length thereof whereby the extremities of the bar may be inserted into their supporting notches. As will be most apparent from FIG. 1, a plurality of vertically spaced bars 38 extend across each side of the display 10, from corner to corner thereof, said bars then being adapted to releasably receive article display cards 40 having an integral hanger portions 42 at their top extremity which enable the cards 40 to be frictionally mounted on the bars 38 in suspended relation, all in a well-known manner, as illustrated. The display cards 40 may have any desired articles, such as jewelry 44 mounted thereon whereby each side of the display will have a plurality of display cards mounted thereon, and since the display is rotatable, it may readily be rotated to present any desired side of the display for convenient viewing and access by prospective customers.

Figure 4:
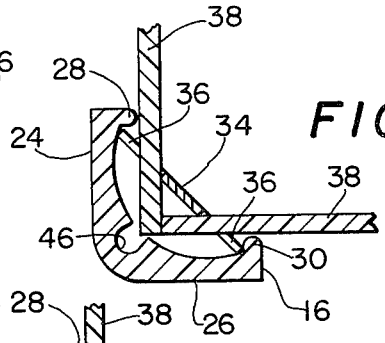
FIG. 4 is a fragmentary section taken through one of the corners of the display stand.
Figure 5:
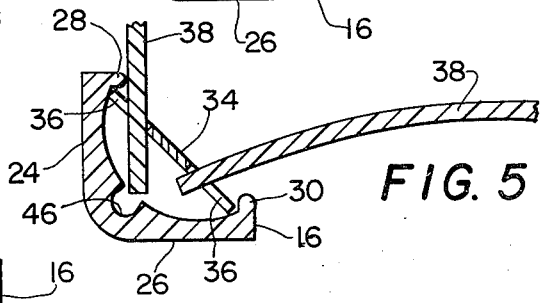
FIG. 5 is a fragmentary section similar to FIG. 4 but showing one of the bars in the process of being mounted.
Figure 3:
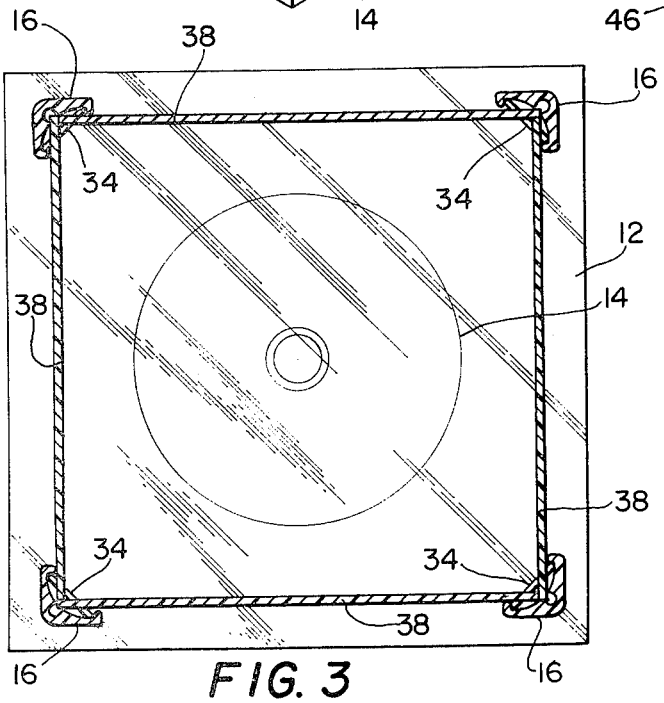
FIG. 3 is a section taken on line 3—3 of FIG. 1.
Figure 6:
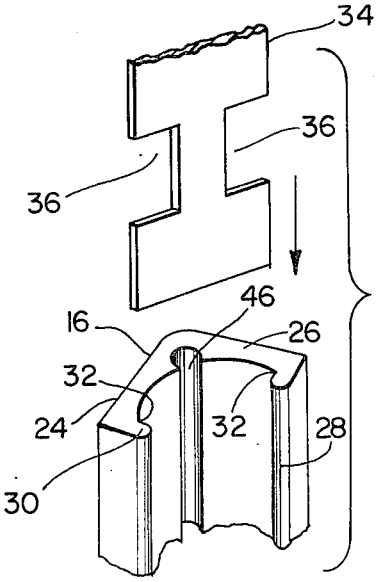
FIG. 6 is a fragmentary exploded perspective view showing one of the corner stanchions and corner strips in detail.
Figure 7:
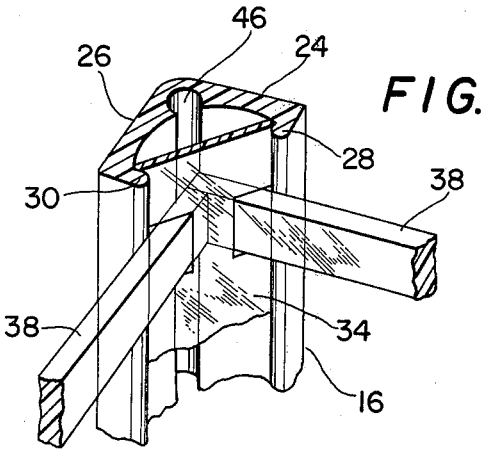
FIG. 7 is a perspective sectional view illustrating the mounting of a pair of bars at one corner of the display.
Figure 8:
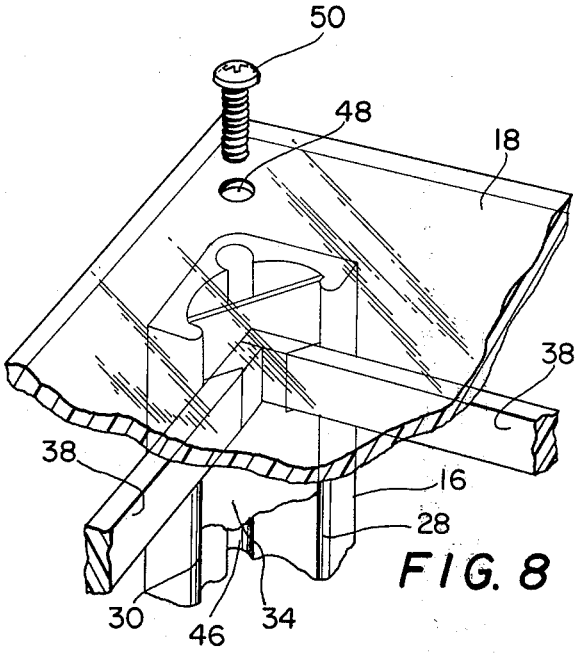
FIG. 8 is a fragmentary perspective view illustrating one means of securing the top plate to the corner stanchions.
Figure 9:
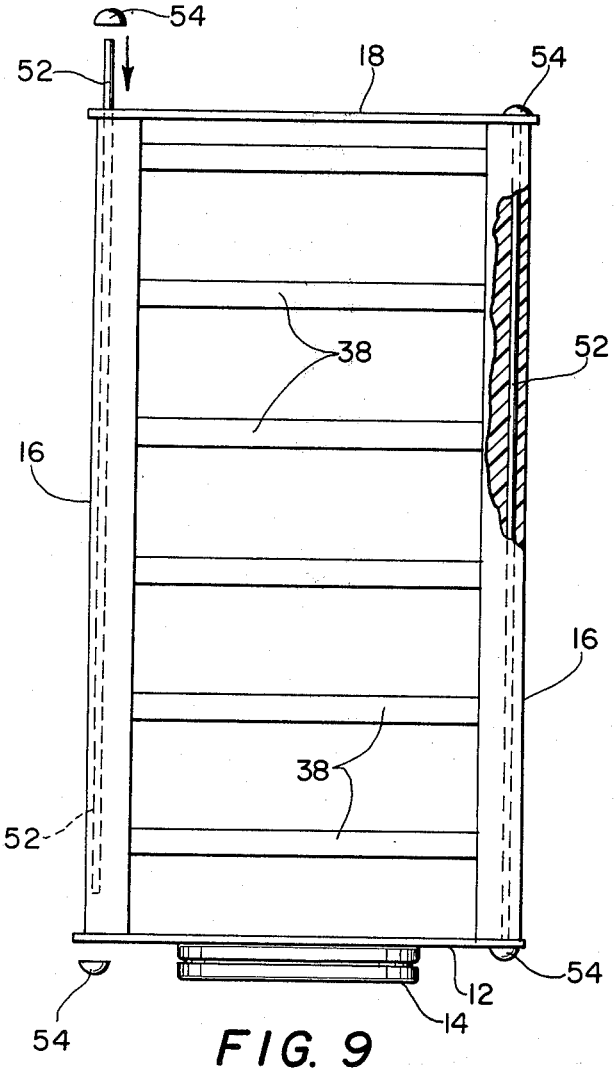
FIG. 9 is a side elevational view, partly broken away, illustrating an alternate means of mounting the top and bottom plates to the corner stanchions.
Figure 10:
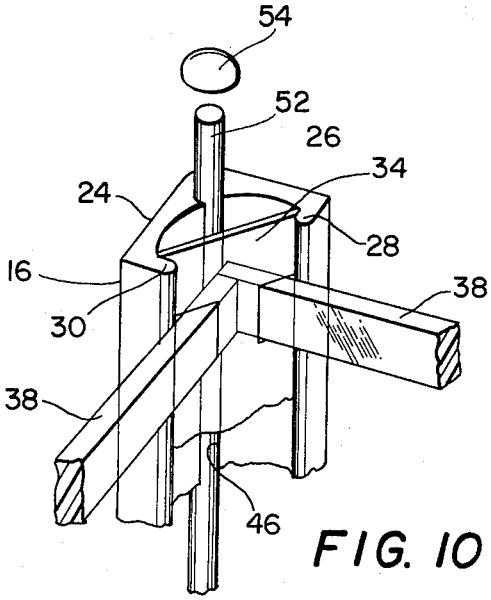
FIG. 10 is a fragmentary perspective view showing in detail the alternate securement means shown in FIG. 9.

As will be seen most clearly in FIGS. 4 through 6, each stanchion 16 is provided with an elongated groove or bore 46 located on the inner surface thereof at the junction of wall portions 24, 26. The groove 46 facilitates securement of the base 12 and top wall 18 to the stanchions 16 and specifically, as illustrated most clearly in FIG. 8, the base and top wall are provided with openings 48 in alignment with the grooves 46 whereupon a self-tapping screw 50 may be inserted through the openings 48 and then threadedly engaged within the bore or groove 46 to effect the desired securement of the parts. FIGS. 9 and 10 show a modified form of securing the base 12 and top wall 18 to the stanchion 16 and specifically in this form an elongated rod 52 is inserted through the openings 48 and then through groove 46, the length of rod 52 being such that its opposite extremities extend just slightly below base 12 and slightly above top wall 18. The exposed opposite extremities then receive any suitable locking cap 54 for maintaining the parts in assembled relation. No matter which form of securement is used, however, it will be understood that in the assembly of the display stand 10, the stanchions are first secured to base 12 and then before top wall 18 is mounted in position, the corner strips 34 are slid downwardly into each stanchion after which, top wall 18 is mounted in position. The support bars 38 are then mounted in position, it being understood that as each support bar is mounted, it is flexed sufficiently so that its opposite ends may enter into its supporting notches 36. Display cards 40 are then mounted on the support bars 38 to complete the display, it being obvious that the vertical spacing between adjacent support bars is slightly greater than the depth of each display card 40 whereupon the bottom edge of each display card will be in spaced relation to the top edge of the display card located therebeneath.

As previously stated, the stanchions 16 are preferably constructed of a light-weight durable plastic and may readily be extruded for convenient and economically feasible manufacture. By the same token, the corner strips 34, the support bars 38, as well as the base and top walls 12, 18 are all preferably of plastic construction such as a suitable acetate or lucite whereupon the entire display stand, with the exception of fastening hardware 50 or 54, is of plastic construction, it being understood that even the rod 52 may be of plastic. Thus, a display stand is provided that is of light-weight yet durable construction, which is economically feasible to manufacture and which may be easily assembled. Also, since display cards may be mounted on all sides of the display, a maximum amount of articles may be displayed using a minimum amount of shelf space.

In some cases it may be desired to display jewelry chain at one or more sides of the display stand 10 in which event the support bars 38 are provided with extensions 56 which receive and display chain 58, as illustrated in FIG. 1. The extensions 56 may be secured to bars 38 by any suitable securement means which may effect either a permanent or detachable connection therebetween.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A display stand comprising a plurality of spaced, upright stanchions defining the corners of said stand, each stanchion having a first wall portion extending generally in the plane of one side of the stand and a second wall portion extending generally in the plane of the adjacent side, said wall portions being connected to each other along a vertical line defining the corner of said stanchions, an elongated strip releasably connected to each stanchion and extending for substantially the vertical extent thereof, the side edges of said strip engaging the inner surfaces of said first and second wall portions adjacent the extremities thereof whereby said strip extends angularly across the inside of said stanchion to define a generally triangular configuration with said wall portions when viewed in cross-section, said strips each have a plurality of spaced support means along their length with the support means of one strip being in horizontal alignment with the support means of the other corner strips, and a plurality of vertically spaced bars extending along each side of the display, the opposite ends of each bar being supported by said support means.

2. The display stand of claim 1 further comprising a base wall secured to the bottom of said stanchions and a top wall secured to the top of said stanchions.

3. The display stand of claim 2 further comprising a turntable assembly secured to the under surface of said base wall whereby said stand may be rotated.

4. The display stand of claim 1 further characterized in that said stanchions each comprise elongated extrusions, the inner surfaces of said wall portions having vertically extending grooves formed therein defining a trackway for slidably receiving said strip.

5. The display stand of claims 1 or 4, said support means comprising notches in the opposite longitudinal edges of said strips, whereby the end portions of said bars extend through said notches and are supported on the bottom edges thereof.

6. The display stand of claim 1 in combination with a plurality of display cards having articles to be displayed mounted thereon, said display cards having hanger means adjacent their upper extremity, said hanger means releasably engaging said bars whereby said cards are suspended therefrom.

7. The display stand of claim 6 further characterized in that said hanger means consists of a hook portion integrally formed adjacent the top of each card.

8. The display stand of claim 6 further characterized in that said bars are vertically spaced from each other a distance slightly greater than the height of said display cards.

9. The display stand of claim 1 further characterized in that said bars are flexible.

10. The display stand of claim 2, said stanchions each having a bore extending from top to bottom thereof adjacent their corner, said bore receiving fastening means for securing said base and top walls to each of said stanchions.

11. The display stand of claim 10, said fastening means comprising self-tapping screws.

12. The display stand of claim 10, said top and base walls each having openings in alignment with said bores, said fastening means comprising an elongated rod passing through each bore and said aligned openings and extending slightly beyond said base and top walls, and retaining means on the exposed ends of said rods.

* * * * *